US007523569B2

(12) United States Patent
Savard

(10) Patent No.: US 7,523,569 B2
(45) Date of Patent: Apr. 28, 2009

(54) MOUNTING FOR A SIDE WING PLOW

(76) Inventor: Normand Savard, 1097, Normandie, Quebec (CA) G5C 3P9

( * ) Notice: Subject to any disclaimer, the term of this patent is extended or adjusted under 35 U.S.C. 154(b) by 139 days.

(21) Appl. No.: 11/359,553

(22) Filed: Feb. 23, 2006

(65) Prior Publication Data

US 2007/0193074 A1 Aug. 23, 2007

(51) Int. Cl.
*E01H 5/06* (2006.01)

(52) U.S. Cl. ..... 37/279; 37/266; 172/742; 172/743

(58) Field of Classification Search ..... 37/218, 37/241, 266, 279, 281, 282, 283; 172/741, 172/742, 743

See application file for complete search history.

(56) References Cited

U.S. PATENT DOCUMENTS 2,991,566 A 7/1961 Sumner et al.
3,061,956 A * 11/1962 Braden ..... 172/782
3,659,363 A 5/1972 Snyder
4,045,892 A 9/1977 Farrell
4,096,652 A 6/1978 Raines et al.
4,357,766 A 11/1982 Croteau et al.
4,596,081 A * 6/1986 DeBilly et al. ..... 37/281
4,969,280 A * 11/1990 Thorneloe ..... 37/281
5,031,343 A * 7/1991 Houle et al. ..... 37/231
6,363,631 B1 4/2002 Cordingley
6,581,307 B1 * 6/2003 Jones et al. ..... 38/281
6,941,686 B2 * 9/2005 Cusick ..... 37/281
7,000,338 B2 * 2/2006 Savard ..... 37/274
7,107,710 B2 * 9/2006 Savard ..... 37/274

* cited by examiner

*Primary Examiner*—Gary S Hartmann
(74) *Attorney, Agent, or Firm*—Equinox Protection; Frank Bonsang, Patent Agent

(57) ABSTRACT

A mounting for a side wing plough includes a mounting having two relatively movable sectorially formed elements, one of which being fixed to the plough and the other being connected to a lifting means for the leading end of the plough. The two elements register with one another and are guided thereby, the interengagement of the elements constituting the connection enabling movement of the plough and also permitting limited compensatory shifting of the plough upon encountering an immovable obstacle. The mounting could further include a tilt mechanism of limited stroke affording the capability of the plough to tilt toward the vehicle to accommodate unpredictable movement of the plough upon impacting an immovable obstacle.

14 Claims, 5 Drawing Sheets

MOUNTING FOR A SIDE WING PLOW

FIELD OF THE INVENTION

The present invention relates to a vehicle-mounted side wing plough such for example as deployed on snow removal equipment or the like and is more particularly concerned with a mounting for the plough.

BACKGROUND OF THE INVENTION

It is well known in the art to use a frontal bracket for mounting a side wing plough or blade on a vehicle to remove snow or other materials from a pavement/sidewalk or roadside. In particular, wings are temporarily mounted for seasonal use on a motor vehicle, and more specifically on a 2 to 3 tons truck with a low profiled chassis. In the prior art, U.S. Pat. No. 2,991,566 issued to Sumner et al. on Jul. 11, 1961; U.S. Pat. No. 3,659,363 issued to Snyder on May 2, 1972; U.S. Pat. No. 4,045,892 issued to Farrell on Sept. 6, 1977; U.S. Pat. No. 4,096,652 issued to Raines et al. on Jun. 27, 1978; U.S. Pat. No. 4,357,766 issued to Croteau et al. on Nov. 9, 1982 and U.S. Pat. No. 6,363,631 issued to Cordingley on Apr. 2, 2002 show a frontal bracket holding the forward section of a side wing via a vertical axis wing attachment pivot that is often combined with a frontward lifting means. In those cases however, the pivot is adjacent the wing whilst the frontward lifting means is secured on the vehicle via a generally complex mounting arrangement.

Problems associated with the existing types of frontal mounting bracket are operational restrictions occasioned by various circumstances. For example the actual positioning of the frontward lifting means, which includes a substantially vertical post, often partially obstructs the view of the driver of the vehicle. Another drawback characteristic of some prior art equipment is that the frontward lifting means prevents the full opening of the hood of the vehicle, thus necessitating disassembly of some parts of the mounting arrangement in order to gain access to the engine compartment. Furthermore, when the vehicle is to be used without the side wing, such as during the summer period, the visually obstructing and cumbersome frontward lifting means generally remains mounted on the vehicle.

All the above mechanisms have their front pivot point or axis extending through the side wing such that when the rear portion of the wing is raised, the bottom front portion wants to dig into the ground surface. U.S. Pat. No. 6,363,631 solves that problem by having the pivot axis toward the front and outside of the wing. The problem associated with the latter is that the bolt forming the pivot takes all the loads and tends to break frequently, thus involving downtime and expense.

Furthermore, during snow plowing operation, when the leading end of the side wing hits an obstacle it is physically lifted up and the rear portion (trailing end) of the side wing resists against its displacement thus limiting the partial raising movement of the side wing and inducing significant loads thereon that could damage the wing attachment points. To remove this resistance, there should be a mechanism that allows the leading end of the side wing to tilt backward while moving up upon obstacle impact.

Accordingly, there is a need for an improved frontward mounting for a side wing with a simple configuration.

SUMMARY OF THE INVENTION

It is therefore a general object of the present invention to provide an improved frontward mounting for a side wing plough.

An advantage of the present invention is that the mounting for a side wing plough provides for a pivoting means adjacent a motor vehicle with a frontward lifting means adjacent the side wing plough.

Another advantage of the present invention is that the mounting for the side wing plough does not restrict vision to the driver of the vehicle.

A further advantage of the present invention is that the mounting for the side wing plough does not prevent direct opening of the vehicle hood.

Still another advantage of the present invention is that the mounting for side wing plough can be removed easily as a unit including the substantially vertical frontward lifting means.

An important additional advantage of the present invention is that the mounting is further adapted to allow limited tilting backward displacement of the leading end of the side wing plough during use upon encountering an obstacle, thereby enabling the plough to ride over it without causing damage.

According to an aspect of the present invention, there is provided a mounting for connecting a side wing plough to a vehicle near side front adjacent a ground surface, the side wing plough having a leading end positionable adjacent said near side front and having a trailing end longitudinally spaced from the leading end and positionable adjacent a vehicle near side, the mounting comprises: a primary mounting means having a first element fixedly associated with the leading end and a second element adapted for securement to the vehicle near side front, the first and second elements being pivotally interconnected at a location distal from the leading end of the plough and being pivotally movable in guiding registration relative one to the other.

Conveniently, the mounting includes a secondary mounting means adapted for disposition intermediate the second element and the vehicle near side front and comprising a plate connected to the second element and pivotally mounted on the vehicle near side front to provide limited tilting movement in a plane parallel to the plane of the vehicle near side.

The vehicle near side front in the context of the present invention means the front of the vehicle on the near side thereof, the mounting being advantageously positionable on a front bumper structure, which is of suitable strength and dimension to support the plough.

The mounting of the invention provides for the location of the frontward lifting means which includes a fluid operable cylinder, conventionally hydraulically powered, fixed to a swivel pin mounting assembly at one end and at the other piston rod end to a slide attached to the second element of the primary mounting means. A slide block attached to the swivel pin mounting assembly registers within the slide.

The first and second elements of the primary mounting means may both conveniently be shaped as a sector of a circle with the first and second element each having a respective arcuate contour, the pivot interconnection being distal the leading end and the respective arcuate contour of each said element being proximal the leading end of the plough. The first element of the primary mounting means has at the respective arcuate contour a guideway within which the respective arcuate contour of the second element registers and is thereby guided. The registration between the first and second elements of the primary mounting means constitutes the mechanism by which movement is transmitted from the lifting means to the plough and thus the loading is borne by these elements and not the pivot. The loading is effectively carried by the frictional engagement of the elements, which also accommodate limited relative movement therebetween caused by the plough encountering an obstacle which displaces the plough from its intended path of travel. The purpose of this allowance of limited relative movement is to prevent damage to the plough and its mounting on the vehicle.

In order to provide an additional facility to cater for any such obstacle the secondary mounting means is provided whereby compensatory movement of the plough is permitted in a plane parallel to the plane of the vehicle near side. In particular, the secondary mounting means allows tilting movement of the plough in a direction towards the vehicle, thus providing dual protection in the event the plough encounters an obstacle. The plate of the secondary mounting means is provided with stops to define the degree of its movement in relation to the vehicle front near side, a striker being affixed to said bumper structure and being disposed between said stops whereby contact between a stop and the striker limits the extent of the compensatory movement.

In a second aspect of the present invention, there is provided a side wing plough for connection to a vehicle and extending between a front near side and a near side of the vehicle the plough including a mounting that comprises: a primary mounting means having a first element fixedly associated with the leading end and a second element adapted for securement to the vehicle front near side, the first and second elements being pivotally interconnected at a location distal from the leading end of the plough and being pivotally movable in guiding registration relative one to the other.

Conveniently, the mounting of the plough includes a secondary mounting means adapted for disposition intermediate the second element and the vehicle front near side and comprising a plate connected to the second element and pivotally mounted on the vehicle near side front to provide limited tilting movement in a plane parallel to the plane of the vehicle near side.

In another aspect of the present invention, there is provided a motor vehicle for ploughing material including a side wing plough and a mounting therefor in accordance with the first and second aspects of the invention respectively.

In a further aspect of the present invention, there is provided a motor vehicle for ploughing material, comprising: a side wing plough having a leading end positioned adjacent a front portion of a near side of the vehicle and having a trailing end longitudinally spaced from the leading end and positioned adjacent the vehicle near side, and a mounting means positioned intermediate the side wing plough leading end and the vehicle near side front portion and comprising a plate connected to a mounting element connected to the plough and pivotally mounted on the vehicle near side front portion, said plate providing limited tilting movement of the plough relative to the vehicle in a plane parallel to the vehicle near side.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, wherein.

Similar references used in different Figures denote similar components.

DETAILED DESCRIPTION OF THE PREFERRED EMBODIMENTS

With reference to the annexed drawings the preferred embodiments of the present invention will be herein described for indicative purpose and by no means as of limitation.

Figure 1:
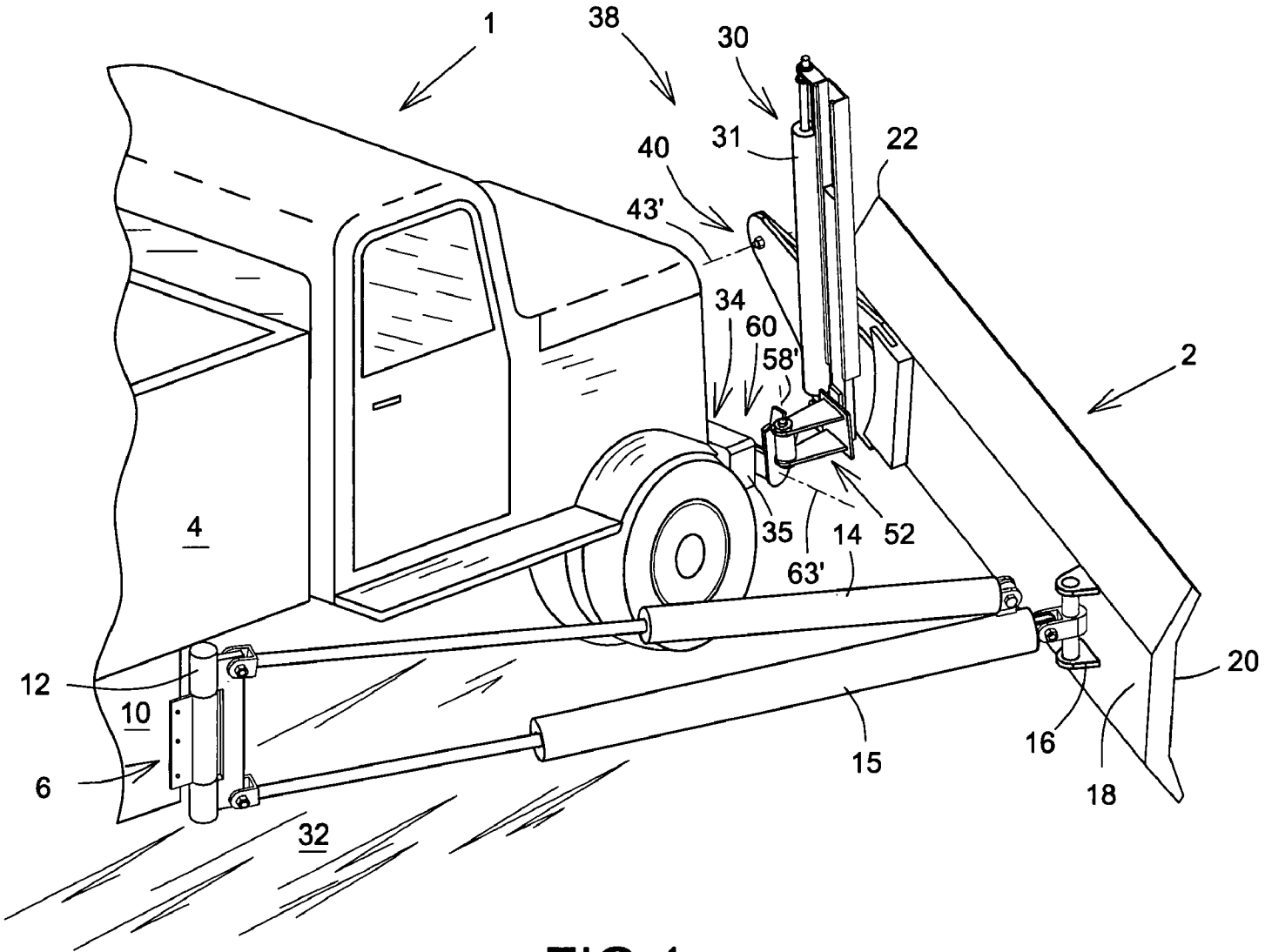
FIG. 1 is a schematic perspective side view of a motor vehicle carrying a side wing plough and a mounting therefor in accordance with an embodiment of the present invention.

Referring to FIG. 1, there is schematically shown a motor vehicle 1 carrying a side wing plough 2 associated with its near side 4, the plough 2 being in the form of a blade connected at 6 to the near side 4 of the vehicle chassis 10 through the agency of a pivot pin arrangement 12. Extending between the pivot pin arrangement 12 and the plough 2 are two hydraulic cylinders 14, 15 which serve to retract the plough 2 into a parked location adjacent the near side 4 when not in use. The cylinder 14 is connected to the cylinder 15 as shown and performs a lifting role whilst the cylinder 15 is operable to retract the plough as aforesaid, there being a suitable pivotal hinge 16 on the rear face 18 of the plough 2 adjacent its trailing end 20.

Figure 2:
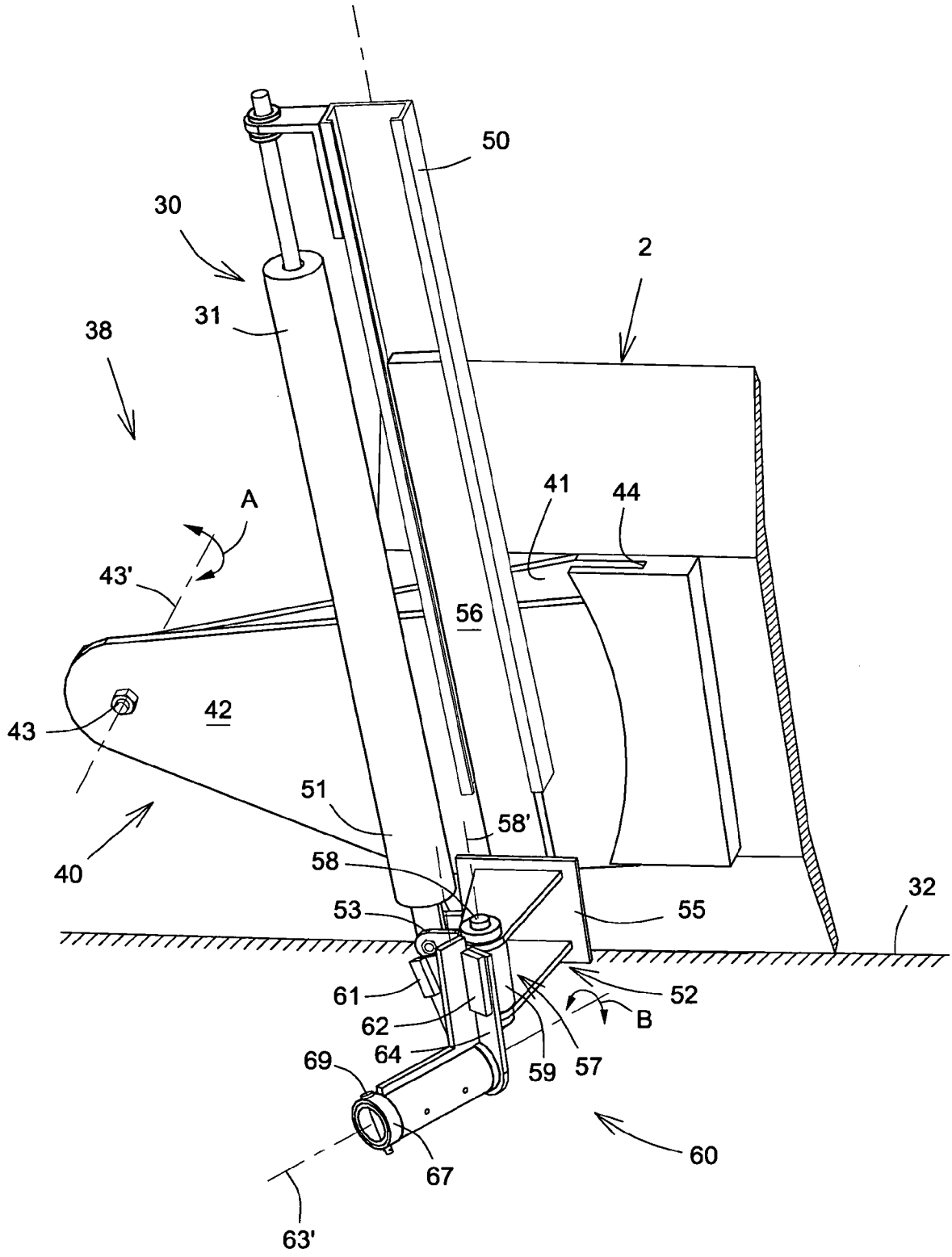
FIG. 2 is a perspective rear view of the side wing plough with the mounting therefor in a normal ploughing position in relation to a ground surface.
Figure 3:
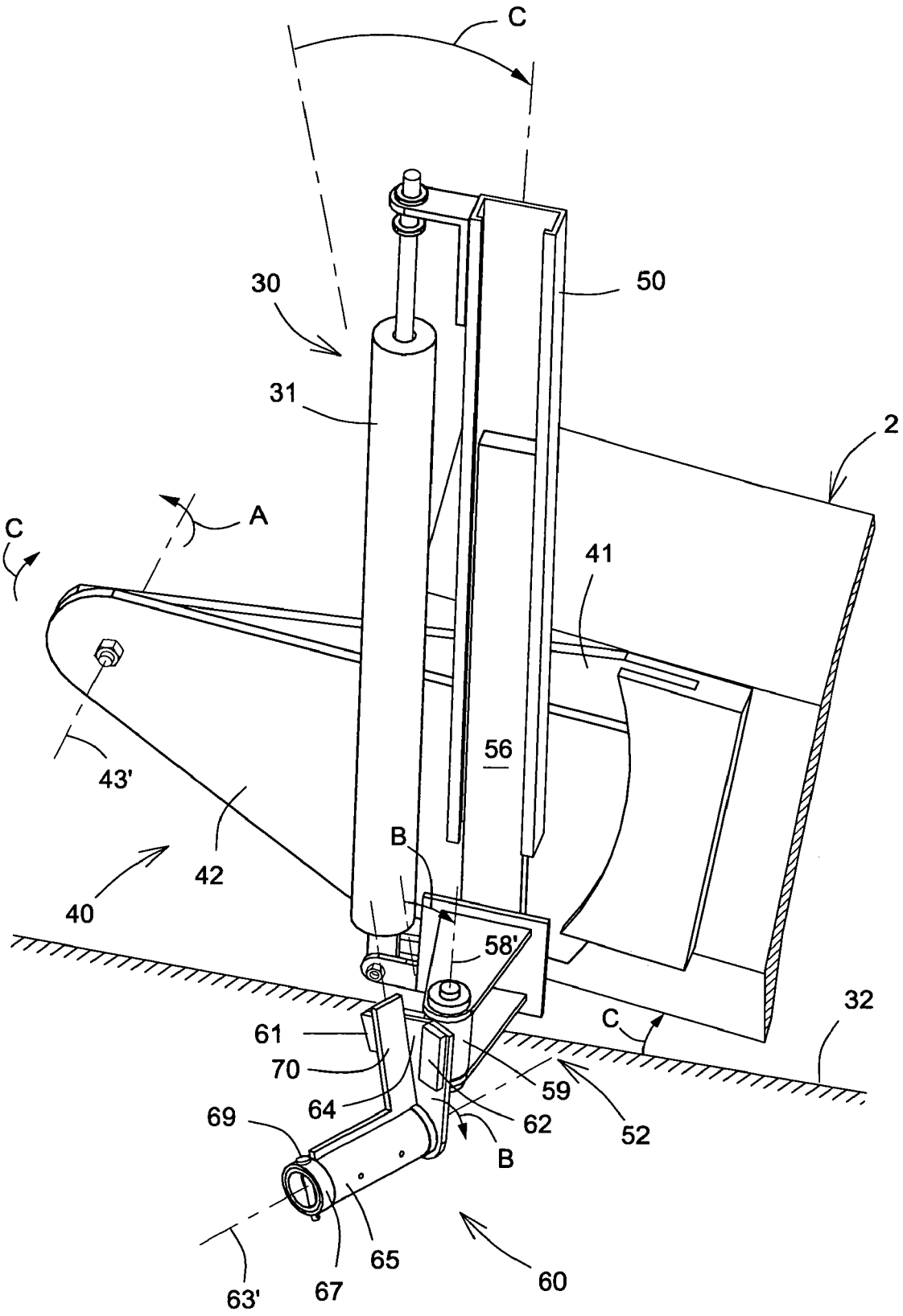
FIG. 3 is a perspective rear view corresponding to that of FIG. 2 showing the plough in a raised position in relation to the ground surface.

Adjacent the leading end 22 of the plough 2 is located frontward lifting means 30, for example a hydraulic cylinder 31, which enables the plough 2 to be raised or lowered into contact with the ground surface 32 (see FIGS. 2 and 3). The lifting means 30 is attached to the near side front 34 of the vehicle 1 and the attachment is achieved by the mounting of the present invention, the near side front of the vehicle being defined by a bumper structure as at 35.

The mounting is shown generally at 38 and includes a primary mounting means 40, or pivoting means, comprising two sector-shaped elements 41, 42 which are generally parallel to one another and pivotally interconnected by a pin 43, with its axis 43', at their apices distal from the leading end 22 of the plough 2 and orthogonal to the plane of the plough. The element 41 is affixed to the rear face 18 of the plough and provides a guideway 44 at its arcuate end, the guideway being so dimensioned as to accommodate in guiding registration the corresponding arcuate end of the element 42. The extent of the relative movement in use as between the elements is of the order of about 30°. The guideway 44 allows the sliding of the arcuate end of element 42 relative to the arcuate end of element 41 during pivoting about pin axis 43' and shown by arrow A of FIGS. 2 and 3, while generally preventing any movement in a direction substantially perpendicular to the sliding motion.

Figure 4:
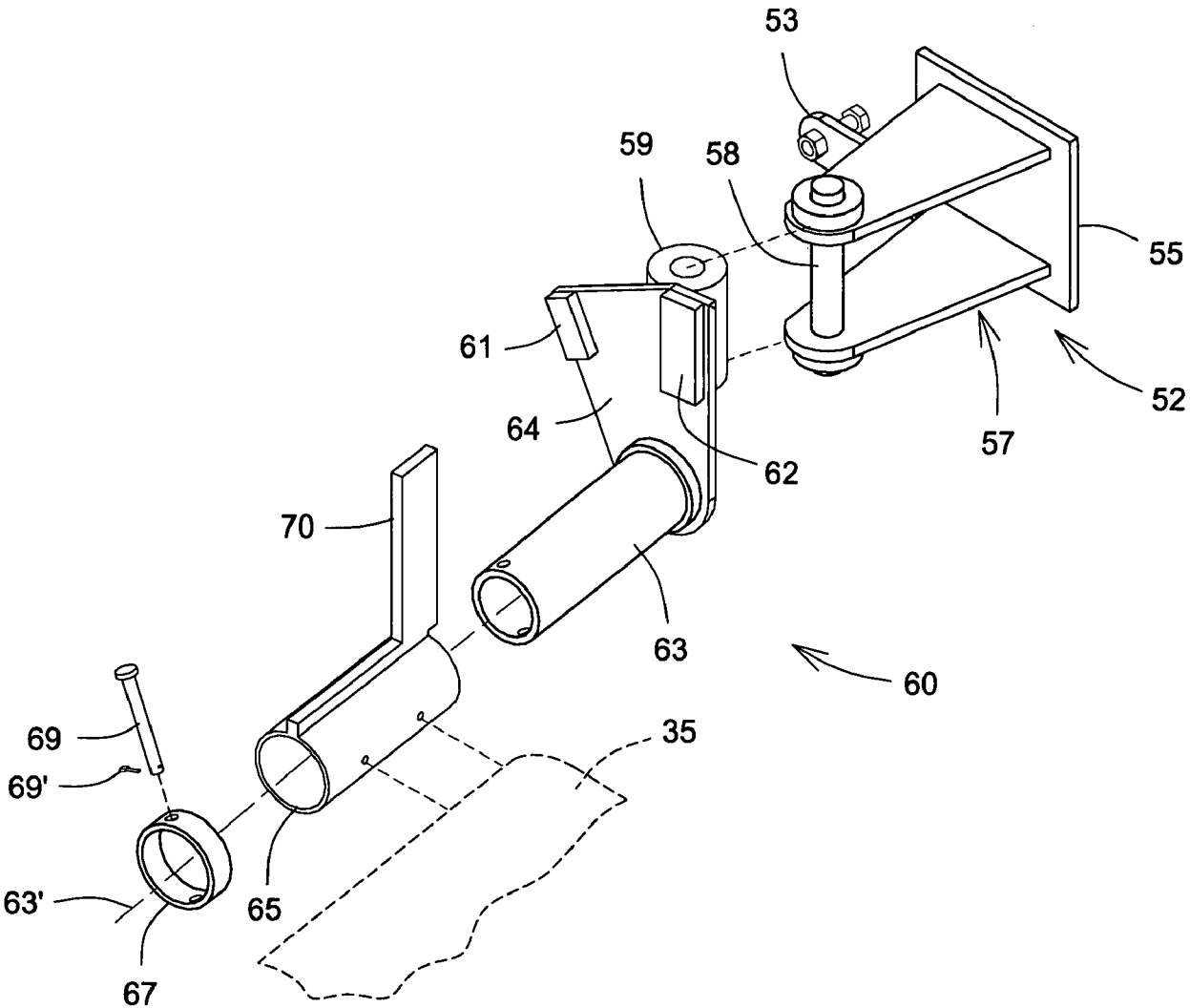
FIG. 4 is an exploded view of the secondary mounting means and the swivel assembly of the mount.

The element 42 has affixed thereto a slideway 50 to which one end is secured to the piston rod of the cylinder 31 whose casing is attached at 51 (see FIGS. 3, 4 and 5) to a lug 53 carried by one side of a first plate 55 of a swivel pin mounting assembly 52 also carrying a slide block 56 longitudinally engageable within the slideway 50. A clevis 57 is provided on the other side of the plate 55 and has a swivel pin 58, with swivel axis 58' generally vertical (in operational position) and parallel to the vehicle near side 4, which registers with a sleeve 59. The swivel arrangement 52 allows the pivoting of the leading end 22 of the side wing 2 upon activation of the cylinders 14, 15 between the parked and the operational positions of the side wing 2.

Sleeve 59 is mounted on a second plate 64 of a secondary mounting means 60, or tilting means. The secondary mounting means 60 is typically disposed intermediate the swivel assembly 52, with the primary mounting means 40, and the bumper structure 35 shown in FIG. 1 and in dotted outline in FIG. 4. The second plate 64 is of substantially triangular shape and bears two stops 61, 62 on its side remote from the sleeve 59. On the same side of the plate 64 as the stops 61, 62 is provided a hollow cylindrical pivot pin 63, with a axis 63' substantially horizontal and perpendicular to the vehicle near side 4, which locates and is rotatable within a hollow cylindrical tube 65 that is affixed in use to the bumper structure 35 by suitable fixtures (not shown). The swivel pin 63 and the tube 65 are held in position relative to one another by the use of a collar 67 and pin 69 secured with clip 69'. The tube 65 is provided with a striker 70 which locates between the stops 61, 62 for a purpose to be explained hereinafter.

In operation the plough 2 is mounted to the motor vehicle 1 at its near side 4 and on the near side front 34 thereof as previously described, the mountings at both locations allowing articulation of the plough 2 from a parked position relatively closely adjacent the near side 4 to an operational position extending outwardly from the near side to assume a ploughing mode to remove material, for example snow, in its path as the vehicle is driven along a roadway, for example. By virtue of the primary mounting means 40, the elevation and descent of the plough 2 at its leading end are effected by the lifting means 30, and through the agency of the sector-shaped elements 41, 42 which afford a range of movement approximating to 30°. The sliding movement and frictional engagement as between the elements 41, 42 provides the load-bearing capacity of the primary mounting means thus removing substantially any stress that would otherwise be placed upon the pin 43. The elements 41, 42 also permit some limited movement in the plane of their engagement in the event that an obstacle is encountered by way of impact or otherwise, the limited movement allowing the plough to override the obstacle thus reducing the likelihood of damage to the plough and its mounting.

Figure 6:
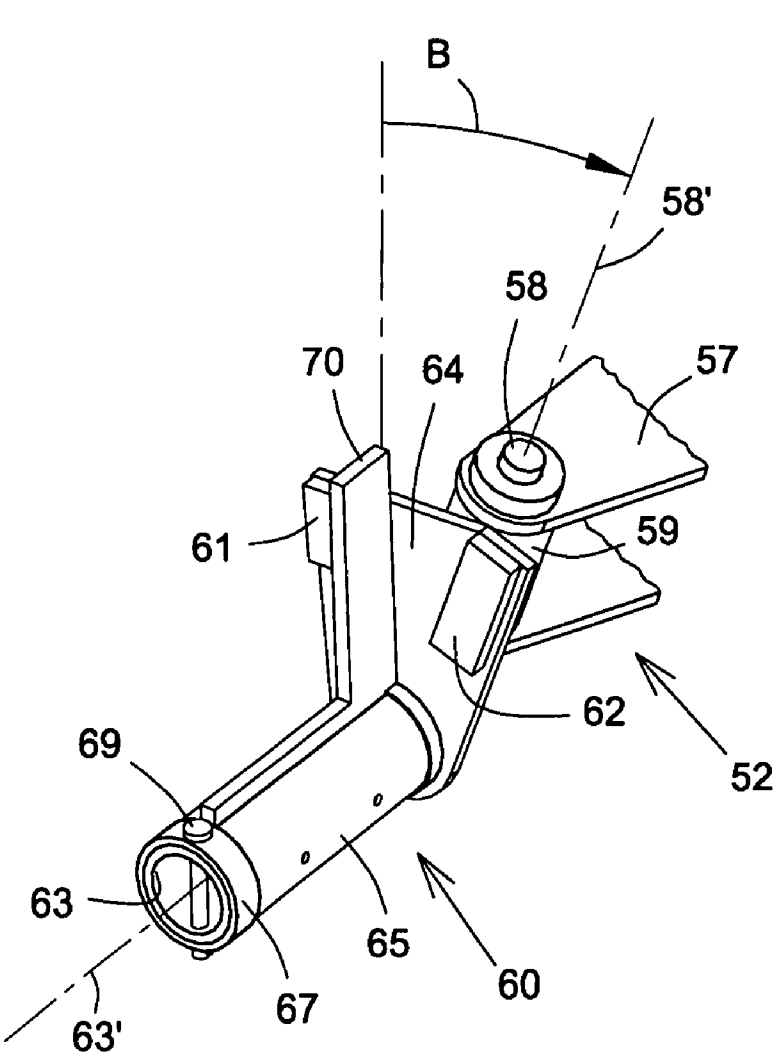
FIGS. 5 and 6 are perspective views of the secondary mounting means illustrated in FIG. 4 and shown in different operational and tilted positions, respectively.
Figure 5:
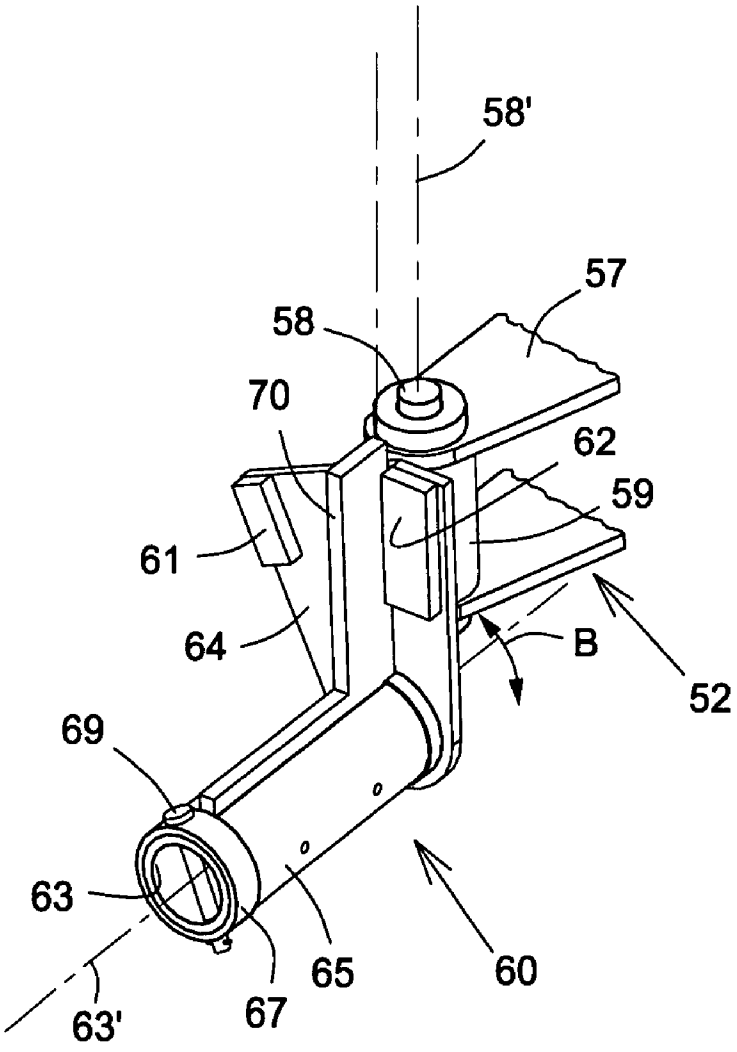

The secondary mounting means 60 further permits limited backward tilting movement, within a plane substantially vertical and parallel to the vehicle near 4 side or along a pivot axis 63' substantially vertical and parallel to the vehicle near side, of the plough by means of the pivot pin 63 rotating within its containing tube 65, as represented by arrows B in FIGS. 2, 3, 5 and 6. The pin 63 being fixed to the plate 64 may move within the range predetermined by the spacing of the stops 61, 62, which act upon the striker 70 to limit any further rotation of the plough towards the vehicle 1 during tilted (raised) position and normal operational position as shown in FIGS. 5 and 6, respectively. The tilting motion about the secondary mounting means 60 and its pivot pin 63 (arrows B in FIGS. 3 and 6) is forced by the lifting of the leading end 22 of the side wing 2 (arrows C) upon impact since the trailing end 20 of the side wing 2 remains in position on the ground 32. In other words, the lifting of the leading end of the wing about the first mounting means 40 is substantially enabled or facilitated by the second mounting means 60. It will be understood that the swivel assembly 52 enables articulation at the leading end of the plough allowing the plough to swing around when it is desired to park it adjacent the side of the vehicle in a similar vein to the manner of operation of the pivotal hinge 16 at the trailing end 20 of the plough.

The present invention thus provides for compensatory motion of the plough away from the ground surface when meeting an unexpected and immovable obstacle, thereby protecting the plough from damage with consequential expense and repair downtime. Additionally the interaction of the sectorial elements of the primary mounting means in the principal operation of the frontward lifting means obviates the problems associated with conventional equipment in which pivot pins have to bear excessive loading, resulting in breakage.

Furthermore, since both the primary and secondary mounting means are of compact construction and of relative simplicity, the operation and maintenance thereof are relatively trouble-free. The compactness also assists in reducing the visibility difficulty attendant upon the usage of currently available alternatives.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A mounting for connecting a side wing plough to a vehicle near side front adjacent a ground surface, the side wing plough having a leading end positionable adjacent said near side front and having a trailing end longitudinally spaced from the leading end and positionable adjacent a vehicle near side, the mounting comprising:

a primary mounting means having a first element fixedly associated with the leading end and a second element adapted for securement to the vehicle near side front, the first and second elements being pivotally interconnected at a location distal from the leading end of the plough and being pivotally movable in guiding registration relative one to the other, with the first and second elements of the primary mounting means being both shaped as a sector of a circle with said first and second element each having a respective arcuate contour, the pivotal interconnection being distal the leading end and the respective arcuate contour of each said element being proximal the leading end of the plough.

2. A mounting according to claim 1, further including a secondary mounting means adapted for disposition intermediate the second element and the vehicle near side front and comprising a plate connected to the second element and pivotally mounted on the vehicle near side front to provide limited tilting movement in a plane parallel to the vehicle near side.

3. A mounting according to claim 2 wherein the mounting provides for the location of a frontward lifting means adapted for the elevation and descent of the plough relative to the vehicle and the ground surface and a swivel pin mounting assembly adapted for the swinging of the trailing end of the plough away and toward the vehicle near side.

4. A mounting according to claim 3 wherein the frontward lifting means extends between the swivel pin mounting assembly and the second element of the primary mounting means.

5. A mounting according to claim 4 wherein the second element of the primary mounting means is provided with a slideway and the frontward lifting means is provided with a complementary slide block.

6. A mounting according to claim 1 wherein the first element of the primary mounting means has at said respective arcuate contour a guideway within which the respective arcuate contour of the second element registers and is thereby guided.

7. A mounting according to claim 6 wherein the interaction between the first and second elements of the primary mounting means constitutes the transmission mechanism for the frontward lifting means to elevate and lower the plough.

8. A mounting according to claim 1 wherein the axis of the pivotal interconnection between said first and second elements is orthogonal to a plane defined by said first and second elements.

9. A mounting according to claim 2 wherein the plate of the secondary mounting means is provided with spaced apart stops and has extending therefrom a pivot pin perpendicular to the vehicle near side, a pivot pin mounting is fixable to the near side front of the vehicle and provides a mount for the pivot pin, the pivot pin mounting bearing a striker for engagement with the stops thereby being adapted to limit the relative movement between the plate and the pivot pin mounting.

10. A side wing plough for connection to a vehicle and extending between a near side front of the vehicle and a near side of the vehicle, the plough including a mounting comprising:

a primary mounting means having a first element fixedly associated with the leading end and a second element adapted for securement to the vehicle near side front, the first and second elements being pivotally interconnected at a location distal from the leading end of the plough and being pivotally movable in guiding registration relative one to the other, with the first and second elements of the primary mounting means being both shaped as a sector of a circle with said first and second element each having a respective arcuate contour, the pivotal interconnection being distal the leading end and the respective arcuate contour of each said element being proximal the leading end of the plough.

11. A motor vehicle for ploughing material including a side wing plough according to claim 10.

12. A plough according to claim 10 wherein the mounting includes a secondary mounting means adapted for disposition intermediate the second element and the vehicle near side front and comprising a plate connected to the second element and pivotally mounted on the vehicle near side front to provide limited tilting movement in a plane parallel to the vehicle near side.

13. A motor vehicle for ploughing material including a side wing plough according to claim 12.

14. A motor vehicle for ploughing material, comprising:

a side wing plough having a leading end positioned adjacent a front portion of a near side of the vehicle and having a trailing end longitudinally spaced from the leading end and positioned adjacent the vehicle near side: and a mounting means positioned intermediate the side wing plough leading end and the vehicle near side front portion and comprising a plate connected to a mounting element connected to the plough and pivotally mounted on the vehicle near side front portion, said plate providing limited tilting movement of the plough relative to the vehicle in a plane parallel to the vehicle near side.

* * * * *